US008997859B1

(12) United States Patent
Ackermann

(10) Patent No.: US 8,997,859 B1
(45) Date of Patent: Apr. 7, 2015

(54) DOWNHOLE TOOL WITH FLUTED ANVIL

(75) Inventor: Eric Brian Ackermann, Salt Lake City, UT (US)

(73) Assignee: Exelis, Inc., McLean, VA (US)

( * ) Notice: Subject to any disclaimer, the term of this patent is extended or adjusted under 35 U.S.C. 154(b) by 428 days.

(21) Appl. No.: 13/469,937

(22) Filed: May 11, 2012

(51) Int. Cl.
*E21B 33/12* (2006.01)
*E21B 29/00* (2006.01)

(52) U.S. Cl.
CPC ..... *E21B 33/1204* (2013.01); *E21B 29/00* (2013.01)

(58) Field of Classification Search
CPC ..... E21B 33/1204; E21B 29/00
USPC ..... 166/117.7, 118, 138
See application file for complete search history.

(56) References Cited

U.S. PATENT DOCUMENTS

| | | | | |
|---|---|---|---|---|
| 2,043,225 | A | | 6/1936 | Armentrout et al. |
| 2,160,804 | A | | 5/1939 | Hall et al. |
| 2,204,658 | A | * | 6/1940 | Burt ..... 166/223 |
| 2,205,119 | A | | 6/1940 | Hall et al. |
| 2,230,712 | A | | 2/1941 | Bendeler et al. |
| 2,249,172 | A | | 7/1941 | Quintrell |
| 2,338,326 | A | | 1/1944 | Green |
| 2,577,068 | A | | 12/1951 | Baker |
| 2,589,506 | A | | 3/1952 | Morrisett |
| 2,672,199 | A | | 3/1954 | McKenna |
| 2,725,941 | A | | 12/1955 | Henshaw |
| 2,784,758 | A | | 3/1957 | Baker |
| 2,969,122 | A | * | 1/1961 | Steffes ..... 175/394 |
| 3,021,902 | A | | 2/1962 | Keithahn |
| 3,136,365 | A | | 6/1964 | Carter et al. |
| 3,148,731 | A | | 9/1964 | Holden |
| 3,163,225 | A | | 12/1964 | Perkins |
| 3,211,232 | A | | 10/1965 | Grimmer |
| 3,298,440 | A | | 1/1967 | Current |
| 3,306,366 | A | | 2/1967 | Muse |
| 3,314,480 | A | | 4/1967 | Scott |
| 3,420,304 | A | | 1/1969 | Kilgore |
| 3,497,003 | A | | 2/1970 | Berryman et al. |
| 3,506,067 | A | | 4/1970 | Lebourg |
| 3,517,742 | A | | 6/1970 | Williams |
| 3,570,595 | A | | 3/1971 | Berryman |
| 3,831,677 | A | | 8/1974 | Mullins |
| 3,976,133 | A | | 8/1976 | Allen |
| 4,099,563 | A | | 7/1978 | Hutchison et al. |
| 4,151,875 | A | | 5/1979 | Sullaway |

(Continued)

OTHER PUBLICATIONS

U.S. Appl. No. 13/176,107, filed Jul. 5, 2011; Nish; office action dated Sep. 11, 2013.

(Continued)

*Primary Examiner* — Robert E Fuller

(57) ABSTRACT

An anvil or mule shoe of a downhole tool disposable in a casing of an oil or gas well includes a scoop formed in a bottom of the downhole tool with a concave profile oriented at an acute angle with respect to a longitudinal axis of the downhole tool and extending across a majority of the bottom; and/or a plurality of helical flutes formed in an exterior of the anvil of the downhole tool and extending circumferentially and helically around the longitudinal axis of the downhole tool.

20 Claims, 6 Drawing Sheets

(56) References Cited

U.S. PATENT DOCUMENTS 4,285,398 A 8/1981 Zandmer et al.
4,289,200 A 9/1981 Fisher, Jr.
RE30,836 E * 12/1981 Bunnelle ..... 96/214
4,312,406 A 1/1982 McLaurin et al.
1,684,266 A 9/1982 Fisher et al.
4,359,090 A 11/1982 Luke
4,397,351 A 8/1983 Harris
4,432,418 A 2/1984 Mayland
4,488,595 A 12/1984 Akkerman
4,524,825 A 6/1985 Fore
4,532,989 A 8/1985 Barker
4,542,788 A 9/1985 Semar
4,553,596 A 11/1985 Graham et al.
4,664,188 A 5/1987 Zunkel et al.
4,665,977 A 5/1987 Mullins
4,708,202 A 11/1987 Sukup et al.
4,730,835 A 3/1988 Wilcox et al.
4,739,829 A 4/1988 Brunner
4,745,972 A 5/1988 Bell et al.
4,784,226 A 11/1988 Wyatt
4,813,481 A 3/1989 Sproul et al.
4,834,184 A 5/1989 Streich et al.
4,858,687 A 8/1989 Watson et al.
4,926,938 A 5/1990 Lindsey, Jr.
4,984,636 A 1/1991 Bailey et al.
5,086,839 A 2/1992 Setterberg, Jr. et al.
5,095,978 A 3/1992 Akkerman et al.
5,131,468 A 7/1992 Lane et al.
5,188,182 A 2/1993 Echols, III et al.
5,224,540 A 7/1993 Streich et al.
5,253,709 A 10/1993 Kendrick et al.
5,271,468 A 12/1993 Streich et al.
5,333,684 A 8/1994 Walter et al.
5,340,626 A 8/1994 Head
5,390,737 A 2/1995 Jacobi et al.
5,392,856 A 2/1995 Broussard, Jr. et al.
5,404,956 A 4/1995 Bohlen et al.
5,413,172 A 5/1995 Laurel
5,422,183 A 6/1995 Sinclair et al.
5,441,111 A 8/1995 Whiteford
5,479,986 A 1/1996 Gano et al.
5,540,279 A 7/1996 Branch et al.
5,542,473 A 8/1996 Pringle et al.
5,553,667 A 9/1996 Budde et al.
5,597,784 A 1/1997 Sinclair et al.
5,607,017 A 3/1997 Owens et al.
5,613,560 A 3/1997 Jelinski et al.
5,678,635 A 10/1997 Dunlap et al.
5,701,959 A 12/1997 Hushbeck et al.
5,749,419 A 5/1998 Coronado et al.
5,765,641 A 6/1998 Shy et al.
5,787,979 A 8/1998 Giroux et al.
5,813,457 A 9/1998 Giroux et al.
5,819,846 A 10/1998 Bolt, Jr.
5,837,656 A 11/1998 Sinclair et al.
5,839,515 A 11/1998 Yuan et al.
5,904,207 A 5/1999 Rubbo et al.
5,924,696 A 7/1999 Frazier
5,941,309 A 8/1999 Appleton
5,984,007 A 11/1999 Yuan et al.
5,990,051 A 11/1999 Ischy et al.
6,009,944 A 1/2000 Gudmestad
6,026,903 A 2/2000 Shy et al.
6,056,053 A 5/2000 Giroux et al.
6,076,600 A 6/2000 Vick, Jr. et al.
6,082,451 A 7/2000 Giroux et al.
6,131,663 A 10/2000 Henley et al.
6,145,593 A 11/2000 Hennig
6,167,957 B1 1/2001 Frazier
6,167,963 B1 1/2001 McMahan et al.
6,189,618 B1 2/2001 Beeman et al.
6,220,349 B1 4/2001 Vargus et al.
6,220,350 B1 4/2001 Brothers et al.
6,244,642 B1 6/2001 Serafin et al.
6,279,656 B1 8/2001 Sinclair et al.
6,318,461 B1 11/2001 Carisella
6,318,729 B1 11/2001 Pitts, Jr. et al.
6,354,372 B1 3/2002 Carisella et al.
6,394,180 B1 5/2002 Berscheidt et al.
6,412,388 B1 7/2002 Frazier
6,431,274 B1 8/2002 Nowlin et al.
6,481,496 B1 11/2002 Jackson et al.
6,491,108 B1 12/2002 Slup et al.
6,491,116 B2 12/2002 Berscheidt et al.
6,540,033 B1 4/2003 Sullivan et al.
6,578,633 B2 6/2003 Slup et al.
6,581,681 B1 6/2003 Zimmerman et al.
6,598,672 B2 7/2003 Bell et al.
6,598,679 B2 7/2003 Robertson
6,599,863 B1 7/2003 Palmer et al.
6,651,738 B1 11/2003 Solfronk et al.
6,651,743 B2 11/2003 Szarka
6,655,459 B2 12/2003 Mackay
6,666,275 B2 12/2003 Neal et al.
6,695,050 B2 2/2004 Winslow et al.
6,695,051 B2 2/2004 Smith et al.
6,708,768 B2 3/2004 Slup et al.
6,708,770 B2 3/2004 Slup et al.
6,712,153 B2 3/2004 Turley et al.
6,732,822 B2 5/2004 Slack et al.
6,752,209 B2 6/2004 Mondelli et al.
6,769,491 B2 8/2004 Zimmerman et al.
6,793,022 B2 9/2004 Vick et al.
6,796,376 B2 9/2004 Frazier
6,799,638 B2 10/2004 Butterfield, Jr.
6,827,150 B2 12/2004 Luke
6,976,534 B2 12/2005 Sutton et al.
6,986,390 B2 1/2006 Doane et al.
7,017,672 B2 3/2006 Owen, Sr.
7,036,602 B2 5/2006 Turley et al.
7,044,230 B2 5/2006 Starr et al.
7,049,272 B2 5/2006 Sinclair et al.
7,093,664 B2 8/2006 Todd et al.
7,124,831 B2 10/2006 Turley et al.
7,163,066 B2 1/2007 Lehr
7,168,494 B2 1/2007 Starr et al.
7,210,533 B2 5/2007 Starr et al.
7,255,178 B2 8/2007 Slup et al.
7,258,165 B1 8/2007 Williams
7,273,099 B2 9/2007 East, Jr. et al.
7,287,596 B2 10/2007 Frazier et al.
7,322,413 B2 1/2008 Rogers et al.
7,337,852 B2 3/2008 Manke et al.
7,350,582 B2 4/2008 McKeachnie et al.
7,353,879 B2 4/2008 Todd et al.
7,373,973 B2 5/2008 Smith et al.
7,380,600 B2 6/2008 Willberg et al.
7,395,856 B2 7/2008 Murray
7,452,161 B2 11/2008 Freyer et al.
7,455,118 B2 11/2008 Roberts et al.
7,461,699 B2 12/2008 Richard et al.
7,464,764 B2 12/2008 Xu
7,475,736 B2 1/2009 Lehr et al.
7,510,018 B2 3/2009 Williamson et al.
7,735,549 B1 6/2010 Nish et al.
7,743,836 B2 6/2010 Cook et al.
7,789,135 B2 9/2010 Turley et al.
7,900,696 B1 3/2011 Nish et al.
7,980,300 B2 7/2011 Roberts et al.
8,127,856 B1 3/2012 Nish et al.
8,162,053 B2 * 4/2012 Green et al. ..... 166/277
8,267,177 B1 9/2012 Vogel et al.
8,403,036 B2 3/2013 Neer et al.
8,590,616 B1 * 11/2013 McClinton et al. ..... 166/135
2002/0070503 A1 6/2002 Zimmerman et al.
2002/0162662 A1 11/2002 Passamaneck et al.
2003/0155112 A1 8/2003 Tiernan et al.
2003/0188862 A1 10/2003 Streich et al.
2003/0226660 A1 12/2003 Winslow et al.
2004/0003928 A1 1/2004 Frazier
2004/0036225 A1 2/2004 Ritter et al.
2004/0045723 A1 3/2004 Slup et al.
2004/0177952 A1 9/2004 Turley et al.
2005/0016775 A1 * 1/2005 Hiranuma et al. ..... 175/403

(56) References Cited

U.S. PATENT DOCUMENTS

| | | | | |
|---|---|---|---|---|
| 2005/0077053 | A1 | 4/2005 | Walker et al. | |
| 2005/0161224 | A1 | 7/2005 | Starr et al. | |
| 2005/0189103 | A1 | 9/2005 | Roberts et al. | |
| 2005/0205264 | A1 | 9/2005 | Starr et al. | |
| 2006/0124307 | A1 | 6/2006 | Turley et al. | |
| 2006/0131031 | A1 | 6/2006 | McKeachnie et al. | |
| 2006/0278405 | A1 | 12/2006 | Turley et al. | |
| 2007/0039160 | A1 | 2/2007 | Turley et al. | |
| 2007/0074873 | A1 | 4/2007 | McKeachnie et al. | |
| 2007/0102165 | A1 | 5/2007 | Slup et al. | |
| 2007/0119600 | A1 | 5/2007 | Slup et al. | |
| 2007/0284097 | A1 | 12/2007 | Swor et al. | |
| 2007/0284114 | A1 | 12/2007 | Swor et al. | |
| 2008/0047717 | A1 | 2/2008 | Frazier et al. | |
| 2008/0060821 | A1 | 3/2008 | Smith et al. | |
| 2008/0073074 | A1 | 3/2008 | Frazier | |
| 2008/0073081 | A1 | 3/2008 | Frazier et al. | |
| 2008/0073086 | A1 | 3/2008 | Cook et al. | |
| 2008/0202764 | A1 | 8/2008 | Clayton et al. | |
| 2008/0257549 | A1 | 10/2008 | Swor et al. | |
| 2009/0000792 | A1 | 1/2009 | Turley et al. | |
| 2009/0038790 | A1 | 2/2009 | Barlow | |
| 2009/0044957 | A1 | 2/2009 | Clayton et al. | |
| 2009/0065194 | A1 | 3/2009 | Frazier | |
| 2009/0078647 | A1 | 3/2009 | Frazier et al. | |
| 2009/0139720 | A1 | 6/2009 | Frazier | |
| 2009/0159274 | A1 | 6/2009 | Frazier | |
| 2009/0178808 | A1 | 7/2009 | Williamson et al. | |
| 2010/0155050 | A1 | 6/2010 | Frazier | |
| 2010/0276159 | A1 | 11/2010 | Mailand et al. | |
| 2010/0282004 | A1 | 11/2010 | Nance et al. | |
| 2010/0288487 | A1 | 11/2010 | Turley et al. | |
| 2011/0079383 | A1 | 4/2011 | Porter et al. | |
| 2013/0140019 | A1* | 6/2013 | Pare et al. | 166/117.5 |

OTHER PUBLICATIONS

U.S. Appl. No. 13/362,185, filed Jan. 31, 2012; Randall W. Nish; office action dated Aug. 29, 2012.

Baker Hughes; Baker Oil Tools Remedial Systems Technical Unit QUIK Drill Composite Bridte Plug and Wireline Adapter Kit Product Family Nos. H40129 and H43848; Feb. 28, 2002; pp. 1-12.

Weatherford FracGaurd Composite Plugs; 2004; 7 pages.

BJ Python Composite Bridge Plug; Product Information; Sep. 20, 2001; 1 page.

Halliburton FAS Drill Squeeze Packers; Drillable Tools; 1999; 6 pages.

Weatherford Completion Systems FracGuard Series Composite Frac Plug 2001; Brochure No. 432.00 and 433.00; 2 pages.

BioBalls MR, Soluble Ball Sealers; www.santrol.com; Applicant believes that the Bioballs ere offered for sale prior to the filing date of applicant's application.

Composite Plugs; Magnum Oil Tools International; 19 pages.

U.S. Appl. No. 13/176,107, filed Jul. 5, 2011; Randall Nish.

U.S. Appl. No. 12/916,095, filed Oct. 29, 2010; Randall Nish.

U.S. Appl. No. 12/916,095, filed Oct. 29, 2010; Randall William Nish; office action dated Mar. 20, 2013.

U.S. Appl. No. 13/362,185, filed Jan. 31, 2012; Randall Nish.

U.S. Appl. No. 12/253,337, filed Oct. 17, 2008; Randall Nish.

U.S. Appl. No. 12/549,652, filed Aug. 28, 2009; Jason Jon Vogel; notice of allowance issued May 23, 2012.

U.S. Appl. No. 12/253,337, filed Oct. 17, 2008; Randall W. Nish; office action dated May 2, 2013.

U.S. Appl. No. 12/253,337, filed Oct. 17, 2008; Randall W. Nish; Notice of Allowance issued Nov. 22, 2013.

* cited by examiner

DOWNHOLE TOOL WITH FLUTED ANVIL

RELATED APPLICATION(S)

This is related to U.S. Pat. No. 7,735,549 (Ser. No. 11/800,448 filed May 3, 2007); U.S. Pat. No. 7,900,696 (Ser. No. 12/253,319 filed Oct. 17, 2008) and U.S. Pat. No. 8,127,856 (Ser. No. 12/353,655, filed Jan. 14, 2009, and claims priority to 61/089,302, filed Aug. 15, 2008); and U.S. patent application Ser. No. 12/253,337, filed Oct. 17, 2008; Ser. No. 12/549,652, filed Aug. 28, 2009, and claims priority to 61/230,345, filed Jul. 31, 2009; and Ser. No. 12/916,095, filed Oct. 29, 2010; 13/176,107, filed Jul. 5, 2011; and Ser. No. 13/362,185, filed Jan. 31, 2012; which are hereby incorporated herein by reference in their entirety and for all purposes.

BACKGROUND

1. Field of the Invention

The present invention relates generally to downhole tools, such as bridge and frac plugs, used in oil and gas wells.

2. Related Art

Oil and gas wells are completed using a complex process involving explosive charges and high pressure fluids. Once drilling is complete, a well is lined with steel pipe backed with cement that bridges the gap between the pipe outer diameter (OD) and rock face. The steel/cement barrier is then perforated with explosive shaped charges. High pressure fluids and proppants (spherical sand or synthetic ceramic beads) are then pumped down the well, through the perforations and into the rock formation to prepare the rock for the flow of gas and oil into the casing and up the well. This fracturing process is repeated as many times as needed.

Another technological improvement has been the use of composite plugs used to complete these unconventional wells. Oil and gas wells are completed using a complex process whereby steel casing pipe is secured in place with cement. The steel/cement barrier and surrounding oil and gas bearing rock layers are then perforated with shaped charges in order to start the flow of oil and gas into the casing and up to the wellhead. As they prepare to perforate at each level, well technicians set a temporary plug in the bore of the steel casing pipe just below where they will perforate. This plug allows them to pump "Frac fluids" and sand down to the perforations and into the reservoir. This fractures the rock and props open the fractures allowing the movement of gas or oil towards the well at that level. Use of the temporary plug prevents contamination of already-fractured levels below. This process is repeated up the well until all desired zones have been stimulated. At each level, the temporary plugs are left in place, so that they can all be drilled out at the end of the process, in a single (but often time-consuming) operation. The ability to drill all the temporary composite plugs in a single pass (often taking only one day) compared to taking days or weeks to drill cast iron plugs has radically changed well completion economics.

One problem encountered during drilling is that as the upper end of the plug is milled away the plug assembly loses its grip on the casing and the lower part of the plug body drops (in a vertical well) down to a lower level. In a horizontal well the lower plug body falls to the low side of the casing. In both vertical and horizontal wells there is often 10 to 100 feet of loose sand that as accumulated on top of the next plug. This sand is from the fracing operation performed at that level. In order to drill out the next plug, the drill bit or mill has to remove the sand column above the plug. As the drill bit or mill is moved to the next station it continues to turn. The mill catches the lower plug body and begins to spin it.

Permanent and temporary plugs use various designs at their upper and lower ends that are intended to allow the lower plug body to lock up (i.e. prevent rotation) to the top of the next plug to improve drill out rates. For example, angled top and bottom ends assure that the plug remnant from an upper stage will engage the top end of the lower plug and not spin when being drilled out. As another example, other plugs accomplish "lock up" with a half circle style of cut at each end. As another example, other plugs have a crenellated lower end and an internal thread in the lower end that matches a thread at the upper end so it appears that lock up occurs when the mill spins the lower end onto the thread on the upper end.

Examples of downhole tools include U.S. Pat. Nos. 5,540,279 and 6,491,108.

SUMMARY OF THE INVENTION

It has been recognized that it would be advantageous to develop a plug that facilitates and/or provides for sand removal that has deposited in a well casing above another plug or downhole tool.

The invention provides a downhole tool disposable in a casing of an oil or gas well. The downhole tool includes a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against a lower anvil on the mandrel. A scoop is formed in a bottom of the lower anvil with a concave profile oriented at an acute angle with respect to a longitudinal axis of the mandrel and extending across a majority of the bottom. A plurality of helical flutes is formed in an exterior of the lower anvil and extending circumferentially and helically around the longitudinal axis of the mandrel.

In addition, the invention provides an anvil configured for a mandrel of a downhole tool disposable in a casing of an oil or gas well. The anvil includes a scoop formed in a bottom of the anvil with a concave profile oriented at an acute angle with respect to a longitudinal axis of the anvil and extending across a majority of the bottom. A plurality of helical flutes is formed in an exterior of the lower anvil and extending circumferentially and helically around the longitudinal axis of the anvil.

In addition, the invention provides a downhole tool disposable in a casing of an oil or gas well. The downhole tool includes a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against a lower anvil on the mandrel. A scoop is formed in a bottom of the lower anvil with a concave profile oriented at an acute angle with respect to a longitudinal axis of the mandrel and extending across a majority of the bottom. A plurality of helical flutes is formed in an exterior of the lower anvil and extending circumferentially and helically around the longitudinal axis of the mandrel. An opposite bevel is formed in the bottom of the anvil opposite the scoop and forming a bottom edge therebetween. The downhole tool includes means on the bottom of the mandrel for engaging a top of another downhole tool disposed under the mandrel to resist rotation of the mandrel with respect to the another downhole tool.

Furthermore, the invention provides a lower portion of a downhole tool disposable in a casing of an oil or gas well. The lower portion includes a scoop formed in a bottom of the downhole tool with a concave profile oriented at an acute angle with respect to a longitudinal axis of the downhole tool and extending across a majority of the bottom; or a plurality of helical flutes formed in an exterior of the lower portion of the downhole tool and extending circumferentially and helically around the longitudinal axis of the downhole tool; or both.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The terms "upper" and "lower" are used herein with respect to the orientation of the plug in an upright, vertical orientation, even though the plug can be used in horizontal orientations or wells, where upper is still towards the upper end of the well and lower is still towards the lower end of the well.

The terms "casing", "pipe" and "well" are used interchangeably herein.

The terms "slips" and "slip rings" are used interchangeably herein.

The terms "spool" and "mandrel" are used interchangeably herein.

The terms "cone" and "slip wedge" are used interchangeably herein.

The terms "downhole tool" and "plug" and "mandrel assembly" are used interchangeably herein.

The terms "anvil" and "lower portion" of the mandrel and/or the downhole tool are used interchangeably herein.

Specification

Figure 1A:
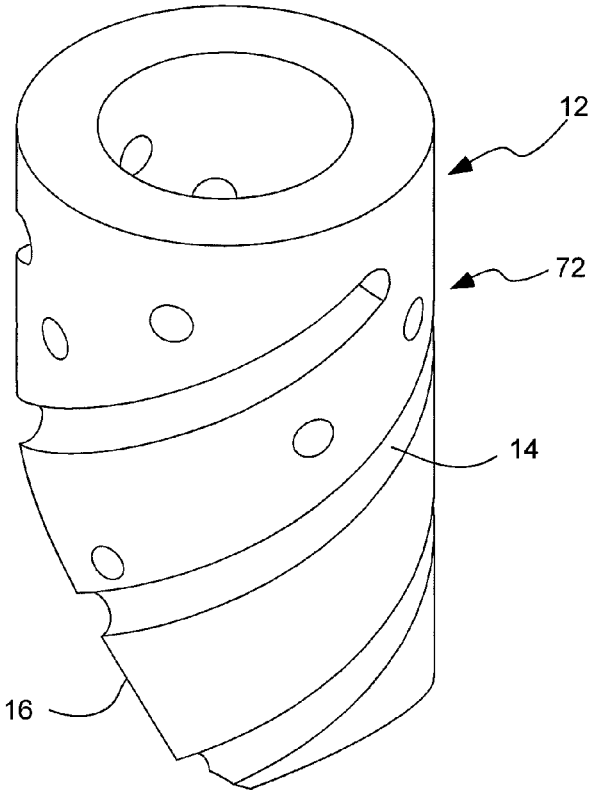
FIG. 1*a* is a perspective view of an anvil or lower portion of a mandrel or downhole tool in accordance with an embodiment of the present invention.
Figure 1B:
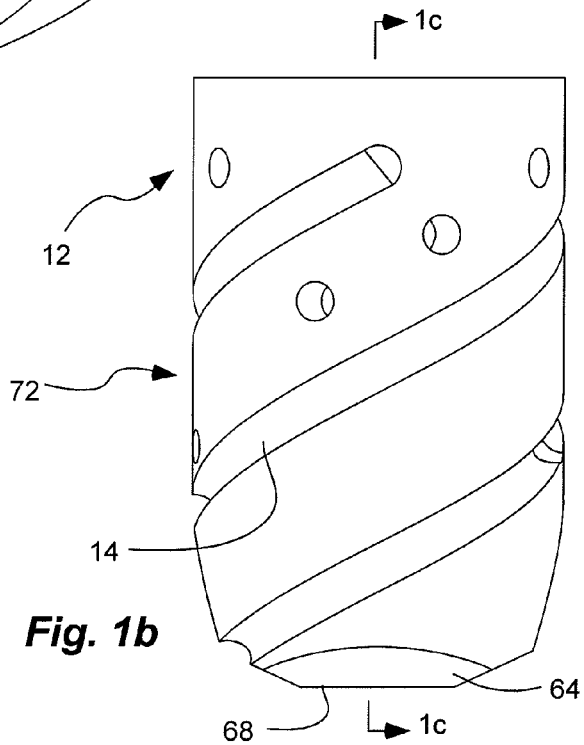
FIG. 1*b* is a side view of the anvil or lower portion of a mandrel or downhole tool of FIG. 1*a;*
Figure 1C:
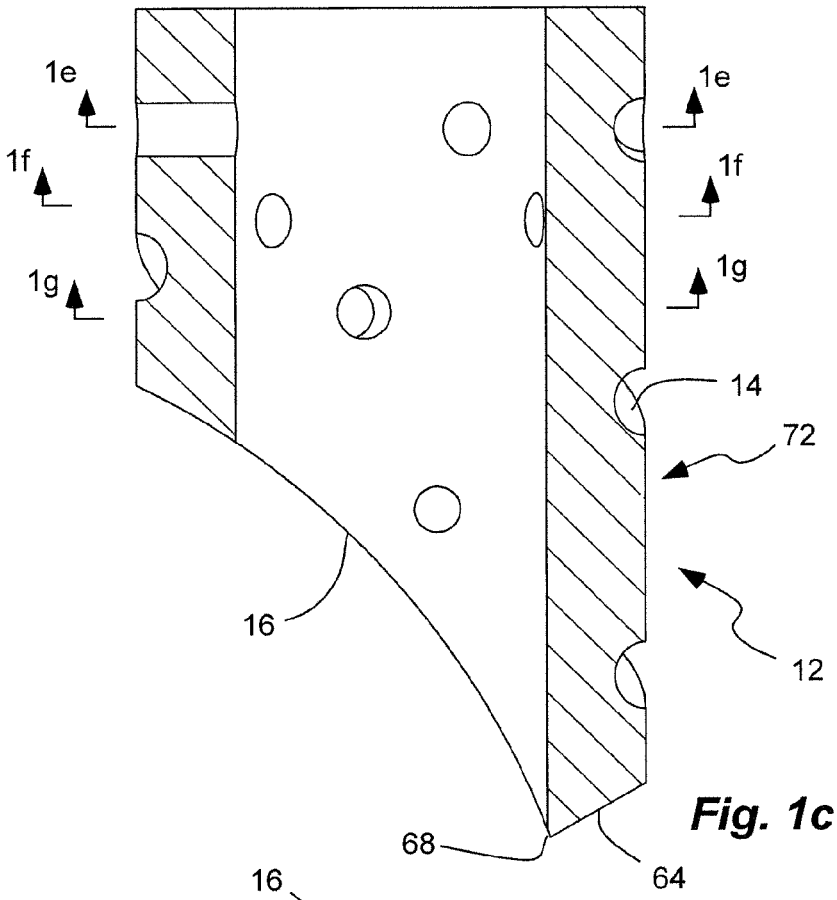
FIG. 1*c* is a cross-sectional side view of the anvil or lower portion of a mandrel or downhole tool of FIG. 1*a* taken along line 1c of FIG. 1*b;*
Figure 1D:
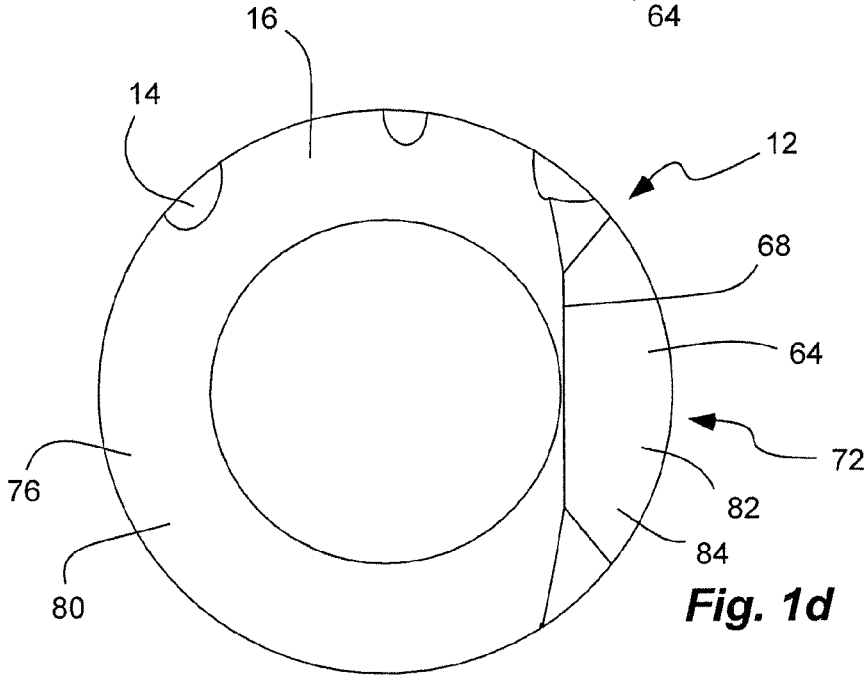
FIG. 1*d* is a bottom view of the anvil or lower portion of a mandrel or downhole tool of FIG. 1*a;*
Figure 1E:
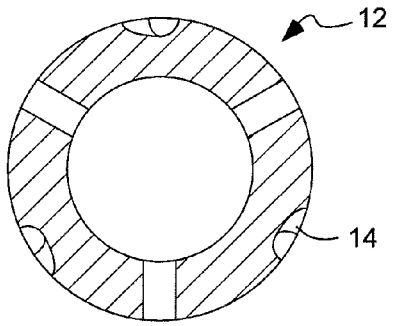
FIGS. 1*e-g* are cross-sectional bottom views of the anvil or lower portion of a mandrel or downhole tool of FIG. 1*a* taken along lines 1e-g, respectively, in FIG. 1*c;*
Figure 1F:
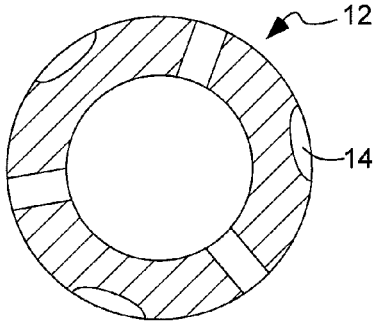
Figure 1G:
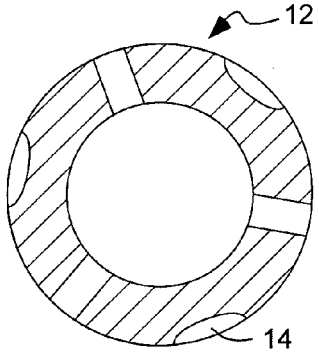
Figure 2:
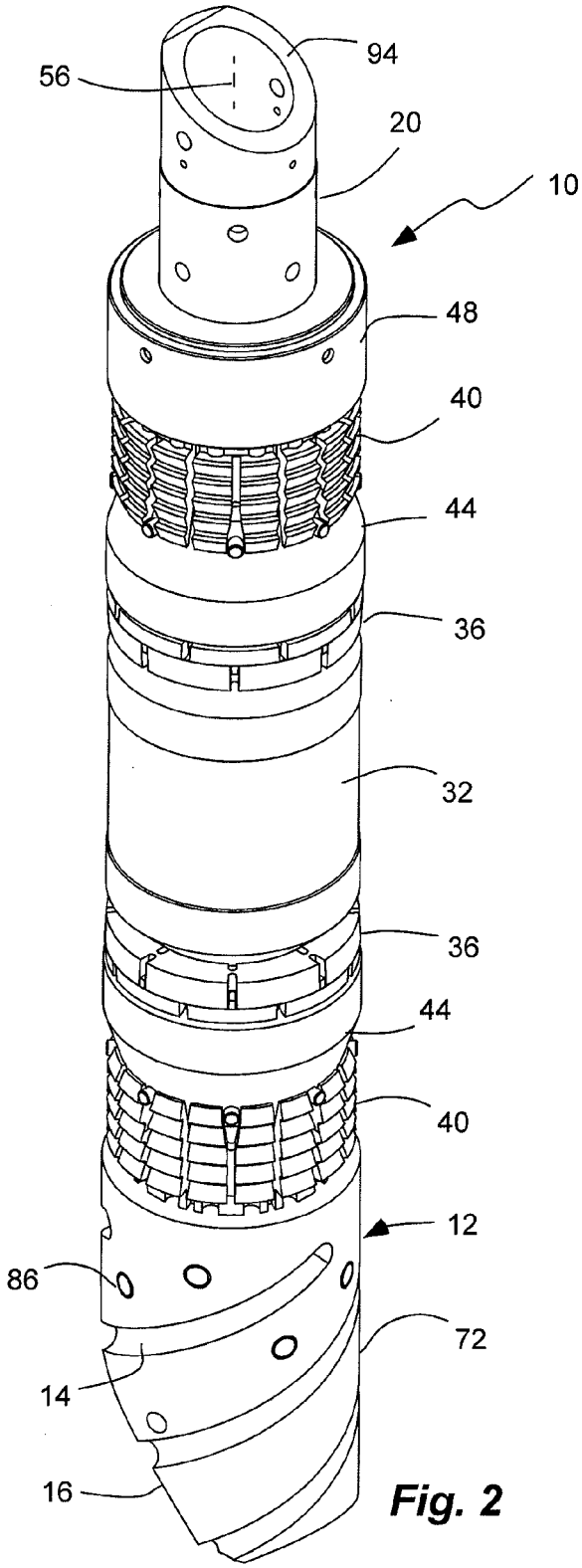
FIG. 2 is a perspective view of a downhole tool in accordance with an embodiment of the present invention with the anvil or lower portion of a mandrel or the downhole tool of FIG. 1*a;*
Figure 3:
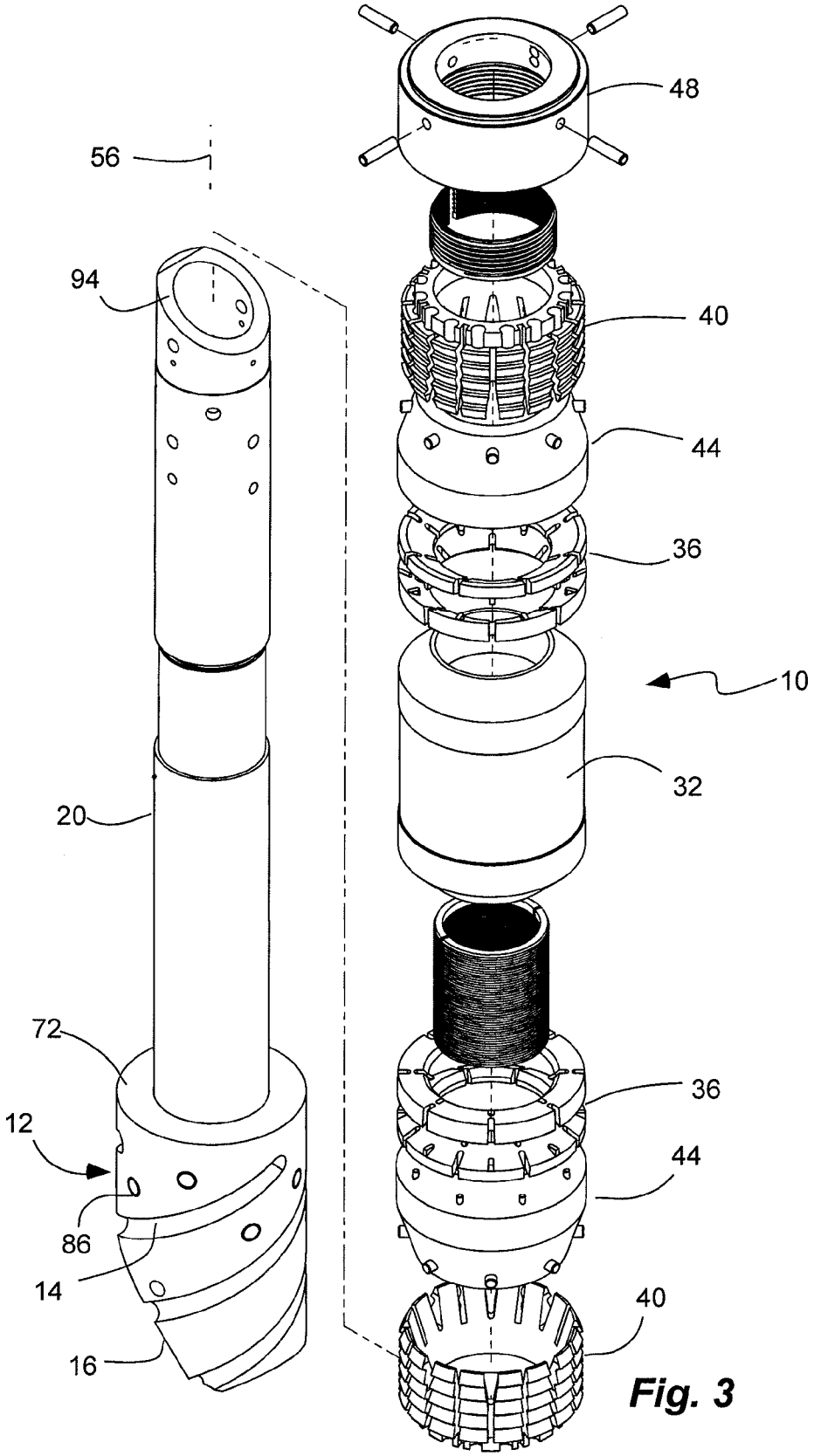
FIG. 3 is an exploded view of the downhole tool of FIG. 2.
Figure 4:
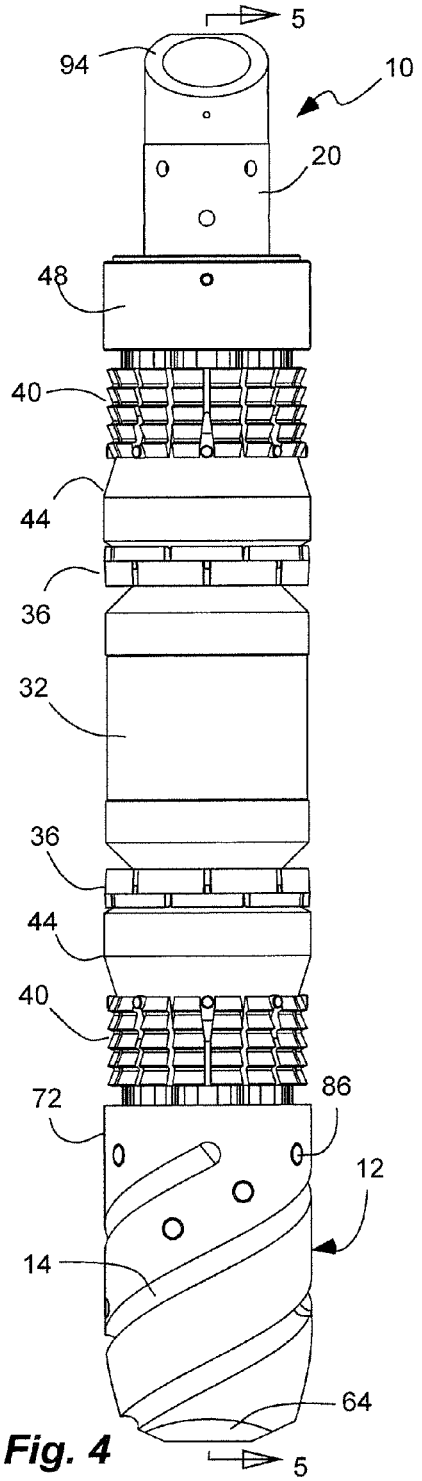
FIG. 4 is a side view of the downhole tool of FIG. 2.
Figure 5:
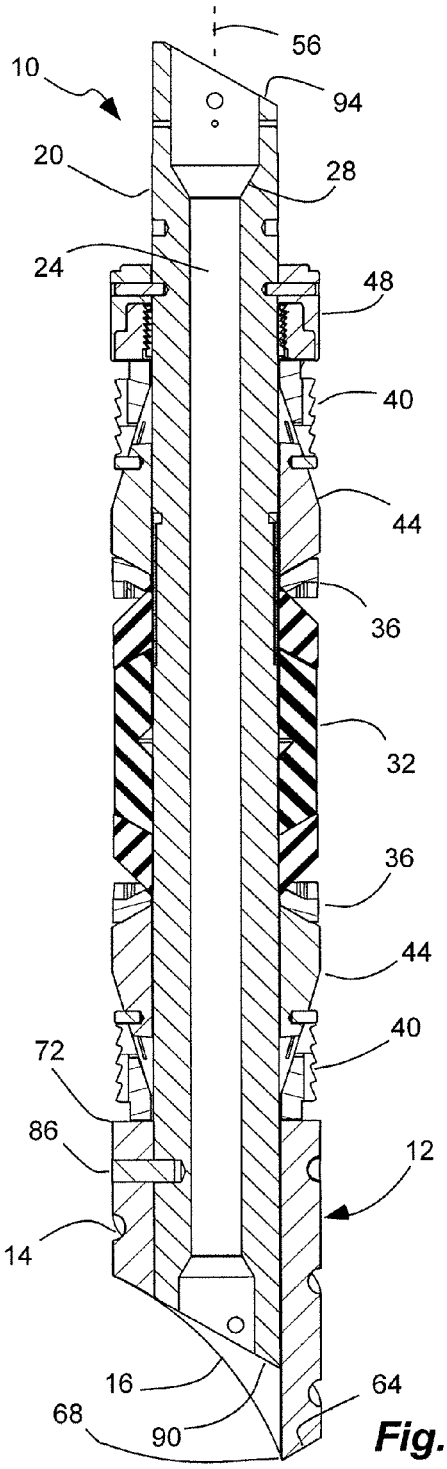
FIG. 5 is a cross-sectional side view of the downhole tool of FIG. 2 taken along line 5 of FIG. 4.

As illustrated in FIGS. 1*a*-5, a downhole tool or plug or mandrel assembly, indicated generally at 10 (FIGS. 2-5), in an example implementation in accordance with the invention is shown for use in a casing or pipe of an oil or gas well. The plug 10 includes an anvil 12 configured to facilitate and/or provide for sand removal that has deposited in a well casing and on top of another plug or downhole tool. The anvil 12 or lower end of the mandrel or downhole tool has a geometry that maximizes the ability of the anvil to auger through sand deposits inside a well casing. The anvil 12 has multiple spiral flutes 14 formed in, such as by machining, the outer diameter of the anvil. In addition, the anvil 12 also has a shovel like geometry or scoop 16 at the end to agitate sand and debris that have settled below the plug in the well. As the particles below the plug are agitated by the shovel geometry, the spiral flutes then port the particles above the anvil and up past the mill or drill where they can then be flowed back to the surface of the well. The radius at the end of the anvil creates a more aggressive "shovel" to dig through the sand deposits. The flutes direct the sand rearward or upward to improve the ability of the lower plug half to dig through the sand when in contact with the mill.

The plug 10 can be configured as one of various different type plugs, such as a bridge plug to restrict flow in either direction (up and down), a fracture ("frac") plug to restrict flow in one direction (typically down), a soluble insert plug that begins as a bridge plug, but then transitions to a frac plug after a predetermined time or condition in the well, etc. It will be appreciated that the plug can be configured as other types of plugs as well. Various aspects of such plugs are shown in U.S. patent application Ser. No. 11/800,448 (U.S. Pat. No. 7,735,549); Ser. No. 12/253,319 (U.S. Pat. No. 7,900,696); Ser. Nos. 12/253,337; 12/353,655 (U.S. Pat. No. 8,127,856); Ser. No. 12/549,652 (61/230,345); and Ser. No. 12/916,095; which are herein incorporated by reference.

The plug or downhole tool 10 includes a center mandrel or mandrel 20 (FIGS. 2-5) that can be made of, or that can include, a composite material, such as a fiber in a resin matrix. Alternatively, the mandrel can be made of metal, such as aluminum or cast iron. The mandrel 20 holds or carries various other components which allow it to be coupled to a setting tool that is lowered into the casing of the well, and which allow it to engage and seal with the casing. Thus, the mandrel has an outer diameter less than an inner diameter of the casing of the well. The mandrel can have a center bore 24 (FIG. 5) which can allow for the flow from the reservoir below when the plug is configured as a frac plug. In addition, the mandrel can have a seat 28 (FIG. 5) disposed in the bore 24. The seat can be formed by an internal annular flange in the bore. The upper portion of the bore, at a top of the plug, and the seat can be configured to receive various different components to determine the type of plug and operating characteristics. For example, a fixed bridge plug can be fixed in the upper portion of the bore and can abut to the seat to seal the bore and form the plug as a bridge plug. As another example, a ball or the like can be movably retained in the upper portion of the bore and movable against and away from the seat, forming a one way check valve, to configure the plug as a frac plug.

One or more rubber elements 32 or packers (FIGS. 2-5) are disposed on and carried by the mandrel. The elements 32 can include one or more compressible rings. Under longitudinal or axial pressure or force, the elements compress longitudinally and expand radially (outward to the casing of the well and inwardly to the mandrel) to fill a space between the mandrel and the casing of the well, thus forming a seal. In addition, one or more backing rings 36 (FIGS. 2-5), such as upper and lower backing rings, can be disposed at opposite sides of the elements and carried by the mandrel to resist longitudinal or axial extrusion of the elements under pressure. One or more slips or slip rings 40 (FIGS. 2-5) (such as upper and lower slips or slip rings) are disposed at opposite sides of the elements and carried by the mandrel. The slips 40 can have teeth on the exterior surface, and can expand or fracture radially to engage and grip the casing of the well. One or more cones 44 (FIGS. 2-5) (such as upper and lower cones) or slip wedges can be carried by the mandrel and associated with each of the one or more slips adjacent the slips to radially displace and fracture the slip rings as a cone and slip ring are pressed together.

Above and below these components are a push sleeve or assembly 48 (FIGS. 2-5) and a lower anvil or mule shoe 12 (FIGS. 2-5) which are structural features designed to resist the hydrostatic, hydrodynamic and compression loads acting on the plug and the elements and their related hardware. Thus, the setting tool presses down on the push sleeve assembly 48, which in turn presses the components against the anvil 12 (or the mule shoe), causing the elements to expand radially and seal, and causing the slips to fracture, slide outward on the cones, and radially bite into the casing to secure the plug in place. As indicated above, components installed in the upper end of the mandrel determine whether the plug will act as a "frac" or "bridge" plug or some other type of plug. The plug can be field configurable, such as by a tool hand "on site" at the well, as a bridge, frac, and/or soluble insert plug. The plug can be shipped direct to the field as described above, with an assembly of elements to seal the casing; backing rings, cones and slips on the mandrel. These components are crushed, pressed or compressed as a setting sleeve acts upon the push sleeve assembly. The elements are forced out to seal the steel casing's inner diameter and the compression load needed to create and maintain the seal is maintained by the slips which lock to the casing's inner diameter. A locking ring inside the push sleeve or push sleeve assembly locks onto a mandrel sleeve which is retained in the composite mandrel via a recess. The teeth in the lock ring and mandrel sleeve prevent the push sleeve from moving backward towards its original position. The compression load needed to create and maintain the seal is maintained by the push sleeve, slips and the anvil. The anvil is held to the mandrel with pins. The slips lock onto the casing's inner diameter. The push sleeve and anvil keep the components compressed. The compression loads acting on the slips are about 25,000 lbs, and must be maintained for weeks or even months at a time.

As described above, the mandrel 20 (FIGS. 2-5) can be formed of or can include, a composite material. The mandrel 20 can have a substantial diameter, except for annular recesses, and except for the anvil 12, which can formed with the mandrel resulting in a larger lower diameter, or affixed thereto such as with pins. Similarly, the cones 44 can be formed of, or can include, a composite material, such as fiberglass or carbon. Alternatively, the cones and/or mandrel can be formed of metal, such as aluminum. The slips can be formed of metal, such as cast iron. The cast iron material of the slips assists in securing the plug in the well casing, while the composite material of the mandrel and the cones eases the drill out procedure. The plug or mandrel can have a longitudinal axis 56 (FIGS. 2-5).

The scoop 16 can be formed in a bottom of the lower anvil (or mandrel or plug). The scoop can have a concave profile oriented at an acute angle with respect to the longitudinal axis 56 of the mandrel. A radius of curvature of the scoop 16 can be greater than a diameter of the anvil 12 or lower end of the mandrel. The axis or center point of the radius of curvature of the scoop can be located outside a lateral or radial perimeter of the scoop, and beyond a distal end of the scoop. Alternatively, the scoop 16 can have a substantially straight or flat profile oriented at an acute angle with respect to the longitudinal axis. The scoop 16 can extend across a majority of the bottom (or across a majority of a diameter of the bottom). In one aspect, the scoop 16 can extend across more than ⅔rds of the bottom (or across more than ⅔rds of the diameter of the bottom). In another aspect, the scoop 16 can extend across more than ¾ths of the bottom (or across more than ¾ths of the diameter of the bottom). In addition, an opposite bevel 64 can be formed in the bottom of the anvil 12 opposite the scoop 16, and forming a bottom edge 68 therebetween.

One or more (at least one, a pair or a plurality of) helical flutes 14 can be formed in an exterior of the lower anvil, and can extend circumferentially and helically around the longitudinal axis 56 of the mandrel. In one aspect, the anvil 12 can have three helical flutes. The flutes can form channels or grooves formed in the exterior of the anvil. The flutes can have a round or curved concave profile or cross-section. The flutes can originate at a lateral side edge of the scoop 16, and can terminate prior to a top of the anvil. Thus, the flutes can have an open lower end. The flutes can be spaced equal distance from one another circumferentially around the longitudinal axis (such as at 120 degrees with respect to one another).

The anvil 12 can include a collar 72 affixed to a lower end of the mandrel. Thus, the mandrel 20 can have a substantially constant outer diameter along the length thereof (except for the recess that receives the mandrel sleeve); with the collar 72 forming the anvil 12 with a greater outer diameter at the end of the mandrel and providing an upper shoulder against which the components are pressed during use. The scoop 16 and the plurality of flutes 14 can be formed in the collar. The collar can have an annular perimeter ridge 76 at a bottom of the collar. The scoop 16 can be formed in a c-shaped bottom portion 80 (FIG. 1*d*) of the annular perimeter ridge 76. A gap 82 (FIG. 1*d*) in the c-shaped bottom portion 80 can be filled by a filler portion 84 forming the opposite bevel 64. A plurality of pins 86 can extend through the collar 72 and into the mandrel 20 to secure the collar to the mandrel. The plurality of pins can be oriented in a helical pattern between the plurality of helical flutes.

The downhole tool can also include means on the bottom of the mandrel for engaging a top of another downhole tool disposed under the mandrel to resist rotation of the mandrel with respect to the another downhole tool. For example, the mandrel 20 can have an angled bottom 90 (FIG. 5) on a bottom of the mandrel forming an acute angle with respect to the longitudinal axis 56 of the mandrel. The angled bottom of the mandrel can be circumscribed by the collar 72. In addition, the mandrel 20, or the another mandrel, can have an angled top 94 on a top of the mandrel forming an acute angle with respect to the longitudinal axis of the mandrel. Thus, as the downhole tool (defining an upper downhole tool) is drilled out and falls onto another downhole tool (defining a lower downhole tool), the angled bottom 90 of the (upper) downhole tool engages the angled top 94 of the another (lower) downhole tool so that the another (lower) downhole tool holds the (upper) downhole tool from moving so that it can be further drilled out (as opposed to rotating with the drill bit). Other means for engaging the top of another downhole tool can include mating lugs; mating screw threads; half circle style of cut at each end; crenellated ends etc.

As described above, residue and/or sand can be disposed over the lower tool, and between the upper and lower tools. The scoop 16 and/or flutes 14 can dig and/or displace the residue or sand from between the two tools so that they can engage one another. A method for drilling out the downhole tool device, defining an upper tool, disposed in a pipe of a well over residue, which in turn is disposed over a lower tool, includes turning the upper tool with a drill bit or mill and turning the scoop of the upper tool into the residue and displacing the residue through the plurality of helical flutes.

Various aspects of downhole tools are shown and described in U.S. Pat. Nos. 7,735,549; 7,900,696 and 8,127,856; and U.S. patent application Ser. No. 12/253,337, filed Oct. 17, 2008; Ser. No. 12/549,652, filed Aug. 29, 2009; Ser. No. 12/916,095, filed Oct. 29, 2010; Ser. No. 13/176,107, filed Jul. 5, 2011; and Ser. No. 13/362,185, filed Jan. 31, 2012; which are hereby incorporated by reference.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A downhole tool device disposable in a casing of an oil or gas well, the device comprising:

a) a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against a lower anvil on the mandrel;

b) a scoop formed in a bottom of the lower anvil with a concave profile oriented at an acute angle with respect to a longitudinal axis of the mandrel and extending across a majority of the bottom; and c) a plurality of helical flutes formed in an exterior of the lower anvil and extending circumferentially and helically around the longitudinal axis of the mandrel.

2. The device in accordance with claim 1, further comprising:

an opposite bevel formed in the bottom of the anvil opposite the scoop and forming a bottom edge therebetween.

3. The device in accordance with claim 2, further comprising:

a collar affixed to a lower end of the mandrel, with the scoop and the plurality of flutes formed in the collar.

4. The device in accordance with claim 3, further comprising:

an annular perimeter ridge at a bottom of the collar;

a c-shaped bottom portion of the annular perimeter ridge forming the scoop; and a gap in the c-shaped bottom portion being filled by a filler portion forming the opposite bevel.

5. The device in accordance with claim 3, further comprising:

a plurality of pins extending through the collar and into the mandrel, the plurality of pins oriented in a helical pattern between the plurality of helical flutes.

6. The device in accordance with claim 3, further comprising:

an angled bottom on a bottom of the mandrel forming an acute angle with respect to the longitudinal axis of the mandrel and circumscribed by the collar; and an angled top on a top of the mandrel forming an acute angle with respect to the longitudinal axis of the mandrel.

7. A method for drilling out a downhole tool device in accordance with claim 1 disposed in a pipe of a well and defining an upper tool disposed over residue which in turn is disposed over a lower tool, the method comprising:

turning the upper tool with a drill bit or mill and turning the scoop of the upper tool into the residue and displacing the residue through the plurality of helical flutes.

8. An anvil device configured for a mandrel of a downhole tool disposable in a casing of an oil or gas well, the device comprising:

a) a single scoop formed in a bottom of the anvil with a concave profile oriented at an acute angle with respect to a longitudinal axis of the anvil and extending across a majority of the bottom of the anvil and having a radius of curvature greater than a diameter of the anvil; and b) a plurality of helical flutes formed in an exterior of the lower anvil and extending circumferentially and helically around the longitudinal axis of the anvil.

9. The device in accordance with claim 8, further comprising:

an opposite bevel formed in the bottom of the anvil opposite the scoop and forming a bottom edge therebetween.

10. The device in accordance with claim 9, further comprising:

a collar with the scoop and the plurality of flutes formed in the collar.

11. The device in accordance with claim 10, further comprising:

an annular perimeter ridge at a bottom of the collar;

a c-shaped bottom portion of the annular perimeter ridge forming the scoop; and a gap in the c-shaped bottom portion being filled by a filler portion forming the opposite bevel.

12. The device in accordance with claim 8, further comprising:

a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against the anvil on the mandrel defining a downhole tool.

13. The device in accordance with claim 12, further comprising:

a plurality of pins extending through the collar and into the mandrel, the plurality of pins oriented in a helical pattern between the plurality of helical flutes.

14. The device in accordance with claim 12, further comprising:

an angled bottom on a bottom of the mandrel forming an acute angle with respect to the longitudinal axis of the mandrel and circumscribed by the collar; and an angled top on a top of the mandrel forming an acute angle with respect to the longitudinal axis of the mandrel.

15. A method for drilling out the downhole tool device in accordance with claim 12 disposed in a pipe of a well and defining an upper tool disposed over residue which in turn is disposed over a lower tool, the method comprising:

turning the upper tool with a drill bit or mill and turning the scoop of the upper tool into the residue and displacing the residue through the plurality of helical flutes.

16. A downhole tool device disposable in a casing of an oil or gas well, the device comprising:

a) a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against a lower anvil on the mandrel;

b) a scoop formed in a bottom of the lower anvil with a concave profile oriented at an acute angle with respect to a longitudinal axis of the mandrel and extending across a majority of the bottom;

c) a plurality of helical flutes formed in an exterior of the lower anvil and extending circumferentially and helically around the longitudinal axis of the mandrel, d) an opposite bevel formed in the bottom of the anvil opposite the scoop and forming a bottom edge therebetween; and e) means on the bottom of the mandrel for engaging a top of another downhole tool disposed under the mandrel to resist rotation of the mandrel with respect to the another downhole tool.

17. The device in accordance with claim 16, wherein the means for engaging a top of another downhole tool comprises:

an angled bottom on a bottom of the mandrel forming an acute angle with respect to the longitudinal axis of the mandrel; and an angled top on the top of an another mandrel of the another downhole tool forming an acute angle with respect to the longitudinal axis of the another mandrel.

18. The device in accordance with claim 16, further comprising:

an opposite bevel formed in the bottom of the anvil opposite the scoop and forming a bottom edge therebetween.

19. The device in accordance with claim 18, further comprising:

a collar affixed to a lower end of the mandrel, with the scoop and the plurality of flutes formed in the collar.

20. A mule shoe device of a downhole plug disposable in a casing of an oil or gas well and having a packer compressible and radially expandable to seal between the mandrel and the casing, the device comprising:

a) a single scoop formed in a bottom of the mule shoe with a concave profile oriented at an acute angle with respect to a longitudinal axis of the downhole plug and extending across a majority of the bottom of the mule shoe and having a radius of curvature greater than a diameter of the bottom of the mule shoe; or b) a plurality of helical flutes formed in an exterior of the mule shoe and extending circumferentially and helically around the longitudinal axis of the downhole plug; or c) both.

* * * * *